United States Patent [19]

Aiello et al.

[11] Patent Number: 4,544,220

[45] Date of Patent: Oct. 1, 1985

[54] CONNECTOR HAVING MEANS FOR POSITIVELY SEATING CONTACTS

[75] Inventors: Richard E. Aiello, Winston-Salem; Stanford C. Moist, Jr., Kernersville; Robert J. Poleshuk, Greensboro; Timothy C. Wildman, Winston-Salem, all of N.C.

[73] Assignee: AMP Incorporated, Harrisburg, Pa.

[21] Appl. No.: 566,233

[22] Filed: Dec. 28, 1983

[51] Int. Cl.[4] ..... H01R 11/00

[52] U.S. Cl. ..... 339/59 M; 339/63 M; 339/217 S

[58] Field of Search ..... 339/59, 63 M, 217 S

[56] References Cited

U.S. PATENT DOCUMENTS

| | | | |
|---|---|---|---|
| 3,327,282 | 6/1967 | Krolak | 339/217 S |
| 3,328,746 | 6/1967 | Schumacher | 339/217 S |
| 3,478,305 | 11/1969 | Chirumbolo | 339/217 S |
| 4,443,048 | 4/1984 | Moist, Jr. | 339/63 M |

*Primary Examiner*—Gil Weidenfeld
*Assistant Examiner*—Paula A. Austin
*Attorney, Agent, or Firm*—F. Brice Faller; Robert W. Pitts

[57] ABSTRACT

Electrical connector assembly comprises a housing having a plurality of cavities therethrough and a retainer having a like plurality of cavities therethrough, said housing and retainer being latchably matable so that said cavities and passages are coaxially aligned. Retainer has contact engaging means formed as sets of spring fingers radially arranged about respective passages and extending from the forward face of the retainer to distal ends of the fingers. Each set of fingers defines a first diameter at said forward face and a second smaller diameter toward said sital ends, the fingers spreading apart resiliently as a contact inserted through the passage reaches the smaller diameter, the fingers returning so that the distal ends engage a shoulder on the contact when same is fully inserted. The fingers and cavities are profiled so that the distal ends will stub against the rearward face of the housing rather than entering cavities when the fingers are spread apart, thereby precluding mating of the housing and retainer when contacts are not fully seated.

3 Claims, 6 Drawing Figures

CONNECTOR HAVING MEANS FOR POSITIVELY SEATING CONTACTS

BACKGROUND OF THE INVENTION

The present invention relates to an electrical connector having means for assuring positive seating of contacts therein.

Pin and socket connectors of the type sold under the name MATE-N-LOK by AMP Incorporated have pin or socket contacts therein which are used to terminate wires coaxially crimped thereto. The contacts are situated in cavities through a housing constructed for mated connection with a complementary housing of another connector assembly.

There is described in U.S. patent application Ser. No. 307,997 now U.S. Pat. No. 4,443,048 a connector assembly as described above which employs a housing having cavities therethrough which receive the mating portions of respective contacts, and a retainer with passages therethrough which are assembled over respective wires. The retainer is latched to the rearward face of the housing to retain the contacts therein and assure that respective mating portions thereof are not unseated sufficiently to preclude mating with a complementary contact in a complementary connector. Improper seating is discovered by unlatching the retainer from the housing, the frictional force of the retainer on the wires causing improperly seated contacts to be withdrawn from the housing. Disadvantageously, the retainer can be fully mated to the housing while one or more contacts therein are not fully seated.

SUMMARY OF THE INVENTION

The electrical connector assembly of the present invention utilizes a housing and retainer designed to preclude the possibility of latching the housing and retainer together unless the contacts are fully seated. The retainer has passages therethrough and contact engaging means, in the form of sets of resilient fingers situated radially about respective passages, extending from the forward face thereof. The passages have a first diameter at the forward face and a second smaller diameter toward the distal ends of the fingers. The contacts each have a mating section at one end and an adjacent bearing section which spreads the fingers apart when it reaches the second diameter as the contact is inserted through the passage from the rearward face of the retainer. The fingers then snap back into position at a seating portion on the contact and the distal ends of the fingers bear on a shoulder between the bearing portion and seating portion to prevent the contact from backing up. When the fingers are spread apart, the distal ends would stub the rearward face of the housing rather than entering a respective cavity.

The contacts thus must be fully seated in the retainer else the retainer cannot be latched to the housing. Any contact not inserted sufficiently to spread the fingers would be readily visible at the rearward face of the retainer.

DETAILED DESCRIPTION OF THE PREFERRED EMBODIMENT

Figure 1:
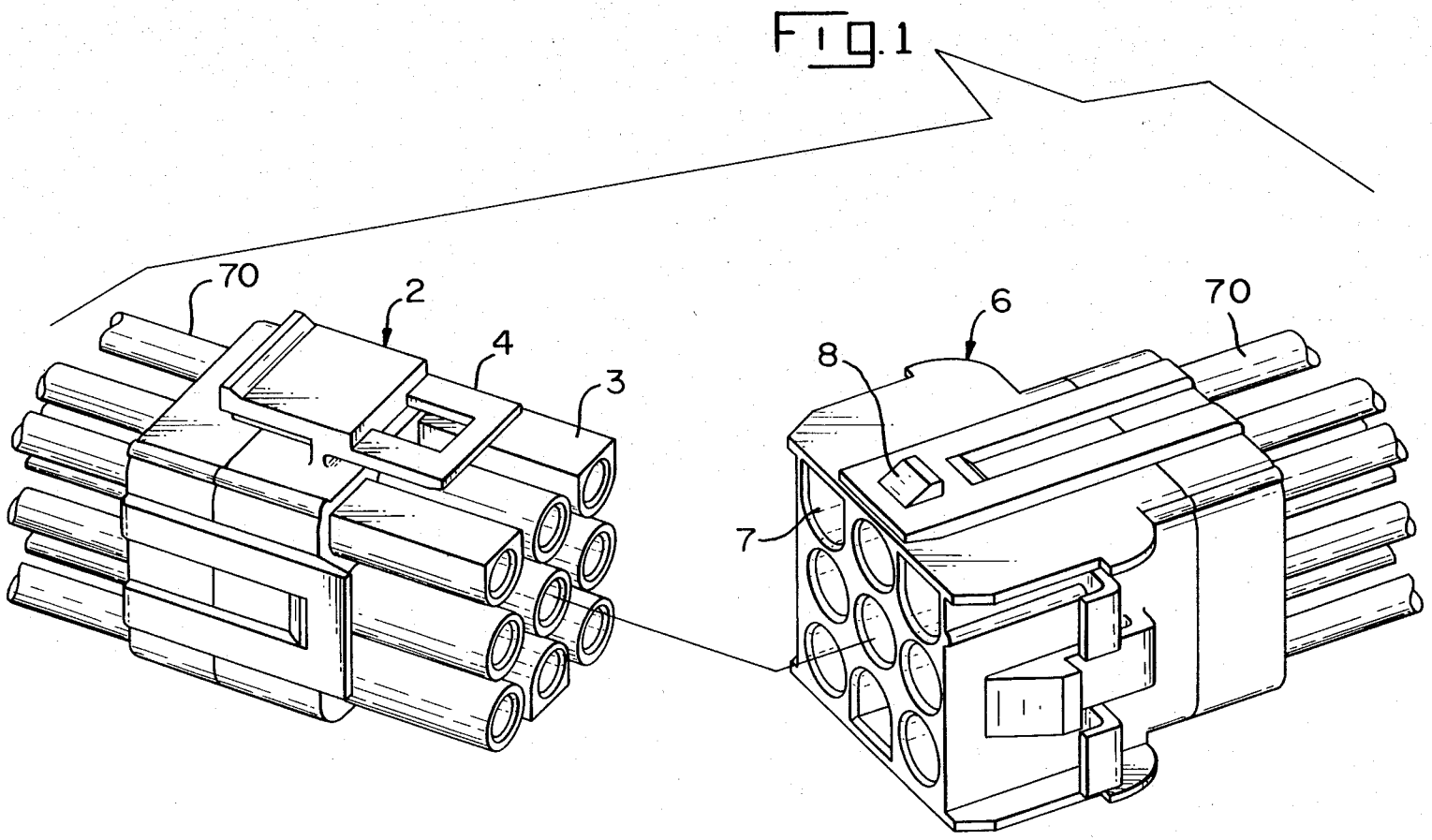
FIG. 1 is a perspective of two matable connector assemblies.

FIG. 1 shows two matable connector assemblies 2, 6 according to the present invention. The socket connector 2 has tubular projections 3 profiled for reception in apertures 7 of pin connector 6, and a pair of latch arms 4 which engage latch 8 when the connectors are mated. The wires 70 which are terminated to the respective connectors 2, 6 are thus electrically connected.

Figure 2:
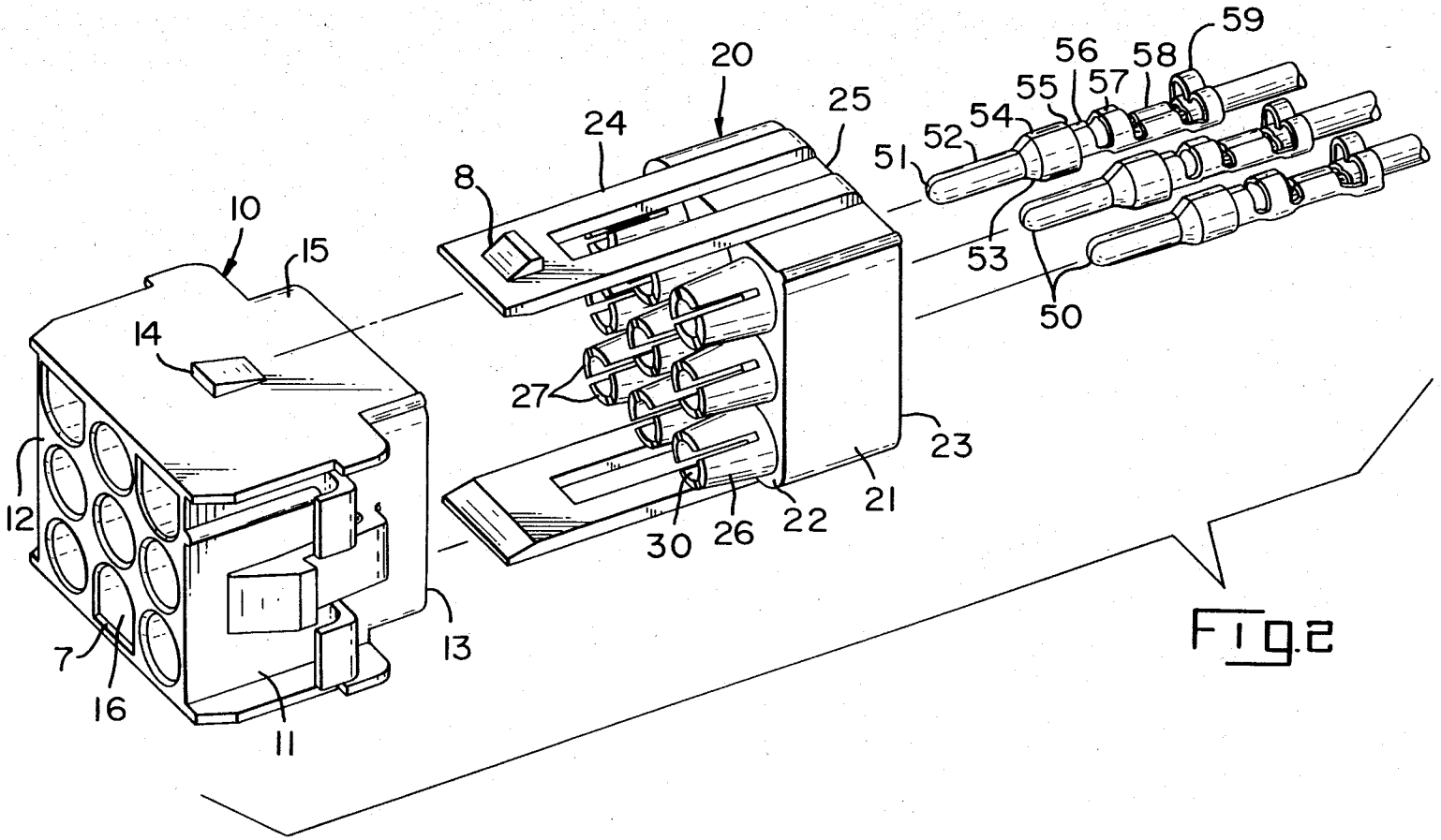
FIG. 2 is an exploded perspective of the pin housing, retainer, and pins.

FIG. 2 is an exploded perspective of a pin connector 6, which comprises a housing 10, retainer 20, and pin contacts 50. The housing 10 has a forward or mating face 12, a rearward face 13, and opposed external endwalls 11 and opposed external sidewalls 15 extending therebetween. The apertures 7 define entries to cavities 16 which also extend between faces 12 and 13. The retainer 20 has a forward or mating face 22, a rearward face 23, and opposed external endwalls 21 and opposed external sidewalls 25 extending therebetween. The sidewalls 25 have latch arms 24 extending therefrom which mate with latches 14 on sidewalls 15 when forward face 22 is flush against rearward face 13. The forward face 22 has contact engaging means extending therefrom, each means comprising a set of four engaging fingers 26 situated radially about a passage 30 which extends from the distal ends 27 of the fingers 26 to the rearward face 23 of the retainer 20. Both the housing 10 and retainer 20 are molded of Valox 357, a thermoplastic with good flexibility. (Valox is a trademark of the General Electric Company.) Pins 50 each comprise a mating portion 52 bounded by distal end 51 and smooth first shoulder 53, which leads to bearing portion 54, which extends to a relatively sharp second shoulder 55 facing away from distal end 51. Seating portion 56 is flanked by second shoulder 55 and third shoulder 57. Behind shoulder 57 the conductor crimp 58 grips strands 71 of wire 70 and strain relief crimp 59 grips the insulation 72.

Figure 3:
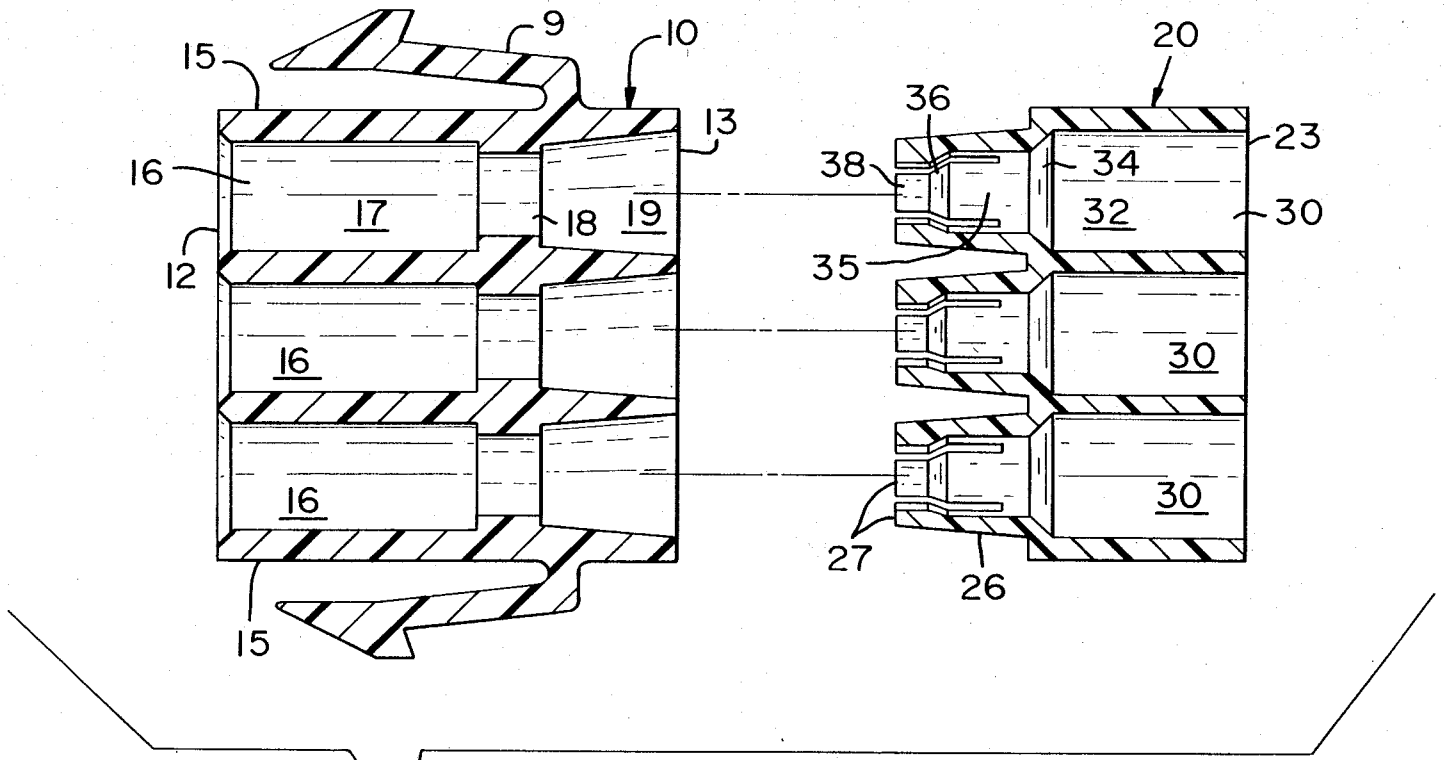
FIG. 3 is a cross section of the pin housing and retainer.

FIG. 3 is a cross section of the housing 10 and retainer 20. The cavities 16 extend through housing 10 from forward face 12 to rearward face 13; each cavity has a forward section 17, an intermediate section 18, and a rearward section 19. Each set of spring fingers 26 is externally profiled to closely fit in rearward section 19 of a cavity 16 when the fingers are not in a deflected state. The passages 30 in retainer 20 extend from rearward face 23 through forward face 22 to the distal ends 27 of fingers 26. Each passage 30 comprises a body section 32 between faces 22, 23 and a first restriction 34 where the passage 30 necks down to an aligning section 35 defined by a first diameter at forward face 22. The aligning section 35 extends to a second restriction 36 where the passage 30 necks down to a spreading section 38 defined by a second diameter smaller than the first diameter. Referring again to FIG. 2, the bearing portion 54 of each pin 50 has a diameter substantially equal to but slightly smaller than the first diameter of aligning section 35. The bearing portion 54 is of necessity slightly smaller to facilitate entry, or in the alternative, may be an interference fit.

Figure 4:
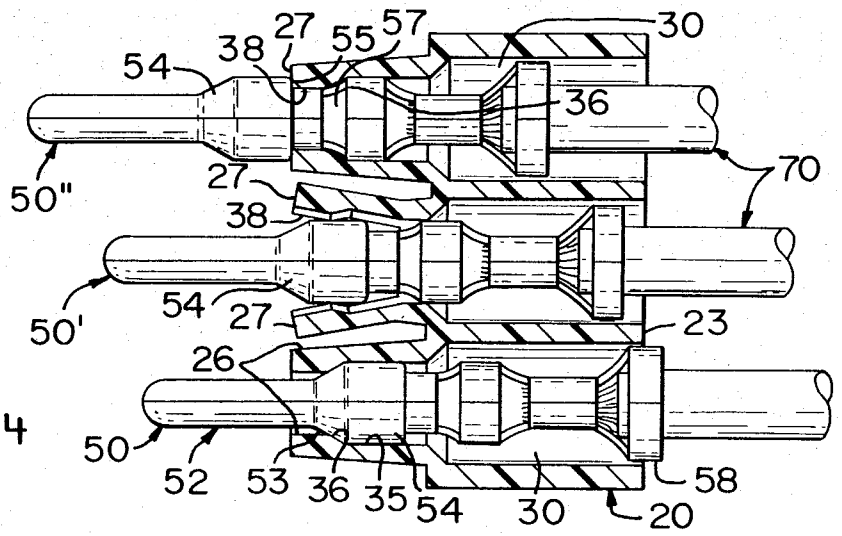
FIG. 4 is a cross section of the retainer with pins inserted at three stages.

FIG. 4 shows the pins 50 in various stages of insertion in a housing 20, indicated by numerals 50, 50′ and 50″. Pin 50 is shown with mating portion 52 protruding from fingers 26 and first shoulder 53 against second restriction 36 of passage 30. The bearing portion 54 is snug in aligning section 35. At this initial stage of insertion no substantial force is yet encountered and the crimp 58 is seen protruding from rearward face 23 so it is visually apparent that the pin 50 is not seated.

Figure 6:
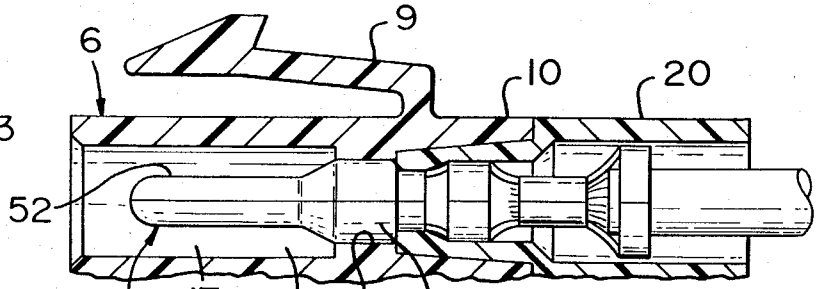
FIG. 6 is a partial section of an assembled socket connector.

Pin 50′ depicts an important feature of the invention. As insertion progresses to this stage, each set of fingers 26 is urged radially apart by bearing section 54 of pin 50′. At this stage of insertion, the fingers 26 are spread apart sufficiently by the force of bearing surface 54 against spreading section 38 to preclude mating of the retainer 20 to a housing 10 (FIG. 3), as the distal ends 27 would stub rearward face 13 rather than entering a cavity 16. A workman attempting to assemble a retainer 20 to a housing 10 would thus readily be aware of any pins not fully seated in a retainer, which situation could preclude mating of pins 50 to sockets 60 (FIG. 6) in the assembled connectors 2, 6.

Referring still to FIG. 4, pin 50″ is fully seated in a passage 30. The bearing portion 54 has passed completely through spreading section 38, allowing fingers 26 to return resiliently so that the distal ends 27 engage second shoulder 55. This prevents back-up of the pin 50″. The third shoulder 57 of the pin 50″ is engaged by second restriction 36 in passage 30 to resist further forward movement of the pin. The fingers 26 have at this stage regained the external profile of the undeflected state, so that they can enter a corresponding cavity 16 in housing 10 (FIG. 3).

Figure 5:
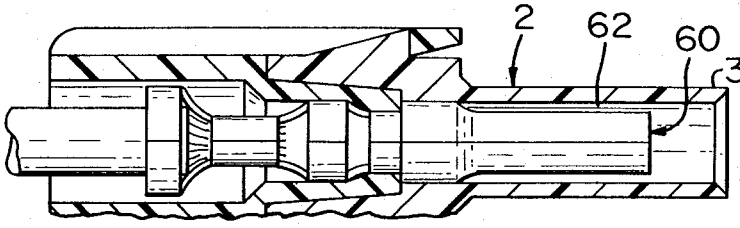
FIG. 5 is a partial section of an assembled pin connector.

FIG. 5 is a partial cross-sectional view of an assembled pin connector 6, showing the pin contact 50 properly seated in retainer 20 and the retainer 20 properly engaged to housing 10, where it is held by latches. The mating portion 52 is coaxially located in forward section 17 of cavity 16 while bearing portion 54 is located closely in intermediate section 18. The positive seating means of the present invention is also used in the corresponding socket connector 2, shown properly assembled in the partial cross-sectional view of FIG. 6. Here the socket contact 60 has a mating portion or socket 62 coaxially located in tubular projection 3, which is profiled for entry in cavity 16, the mating portions 52, 62 likewise being telescopically mated. The latch arm 9 is for engaging the connector 6 to a panel board if desired.

The foregoing is exemplary and not intended to limit the scope of the claims which follow.

We claim:

1. An electrical connector assembly comprising:

a housing having a forward face and a rearward face, said forward face being constructed for mated connection with a complementary housing of another connector assembly, a plurality of cavities extending between said forward face and said rearward face;

a retainer having a forward face and a rearward face, said retainer having projecting from the forward face thereof a plurality of contact engaging means arranged for entry in respective cavities at the rearward face of said housing, each engaging means comprising a plurality of resilient contact engaging fingers situated radially about a passage which extends from the rearward end of said retainer to the distal ends of said fingers each resilient finger being sufficiently expandable to stub the rearward face of said housing adjacent a corresponding housing cavity, each said passage having a first diameter at said forward face and a second more restricted diameter toward the distal ends of said fingers;

a plurality of elongate contacts each having a mating portion at one end, a wire connecting portion at the other end, and a bearing portion therebetween, said bearing portion being bounded by the mating portion at a shoulder facing away from said one end, said mating portion being smaller than said first diameter, said bearing portion having a diameter equal to or smaller than said first diameter but larger than said second diameter, the diameter of the bearing portion being sufficient to engage the resilient fingers and expand the resilient fingers to stub the rearward face of said housing adjacent a corresponding housing cavity, whereby, upon moving one of said contacts through one of said passages from the rearward face of the retainer, said bearing portion will urge said resilient fingers apart as it approaches the distal ends thereof, said fingers at this stage precluding entry of said engaging means into a respective cavity at the rear face of said housing, and upon moving said contacts further through said passage until said bearing portion passes the distal ends of the fingers, said ends will return resilient to engage said shoulder, whereby said forward face of said retainer cannot be mated against said rearward face of said housing unless contacts in passages are fully inserted, and said contact cannot back out when fully inserted.

2. An electrical connector as in claim 1 wherein said retainer further comprises a restriction in said passage between said forward face and said distal ends, said restriction necking said passage down between said first diameter and said second diameter, said contact further comprising a seating portion adjacent said bearing portion opposite said mating portion, said seating portion being bounded by said shoulder facing away from said one end and an opposed shoulder facing said end, said opposed shoulder being positioned to bear against said restriction when said distal ends engage said shoulder, whereby, said distal ends prevent back-up of said contact while said restriction prevents over-insertion, said contacts thus being positively positioned.

3. An electrical connector assembly comprising:

a housing having a plurality of cavities extending therethrough;

a retainer having a plurality of resilient fingers, each insertable into corresponding housing cavities, each resilient finger being sufficiently expandable to stub the housing adjacent the corresponding cavity, preventing insertion therein;

a plurality of elongate contacts, each contact being insertable through corresponding resilient fingers, each contact having a mating portion, a wire connecting portion and a bearing portion therebetween, the bearing portion defining a shoulder engagable with the resilient fingers upon insertion therethrough, the resilient fingers retaining the contacts against removal, for insertion of the contacts and resilient fingers into corresponding housing cavities; the diameter of the bearing portion being sufficient to engage and expand the resilient fingers to stub the housing adjacent a corresponding housing cavity preventing insertion therein; whereby the resilient fingers prevent mating between the housing and the retainer unless the contacts are secured against removal from the retainer.

* * * * *